US009640146B2

(12) United States Patent
Chiang

(10) Patent No.: US 9,640,146 B2
(45) Date of Patent: May 2, 2017

(54) METHOD FOR PERFORMING DITHERING UPON BOTH NORMAL MODE AND SELF REFRESH MODE IN LOWER TRANSMISSION DATA RATE AND RELATED APPARATUS

(71) Applicant: HIMAX TECHNOLOGIES LIMITED, Tainan (TW)

(72) Inventor: Chi-Cheng Chiang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 312 days.

(21) Appl. No.: 14/017,316

(22) Filed: Sep. 4, 2013

(65) Prior Publication Data

US 2015/0062149 A1 Mar. 5, 2015

(51) Int. Cl.
*G09G 3/20* (2006.01)
*G09G 5/18* (2006.01)

(52) U.S. Cl.
CPC ..... *G09G 5/18* (2013.01); *G09G 3/2044* (2013.01); *G09G 2340/0435* (2013.01); *G09G 2350/00* (2013.01)

(58) Field of Classification Search
CPC ..... G09G 2320/046; G09G 2330/021; G09G 2330/022
USPC ..... 345/596–599, 99
See application file for complete search history.

(56) References Cited

U.S. PATENT DOCUMENTS

2001/0026279 A1* 10/2001 Asano ..... G09G 5/39 345/531
2007/0279432 A1* 12/2007 Noel ..... G09G 5/02 345/596
2009/0135304 A1* 5/2009 Inoue ..... G09G 3/3208 348/712
2010/0177126 A1* 7/2010 Inoue ..... H04N 5/202 345/690
2012/0206461 A1* 8/2012 Wyatt ..... G09G 5/003 345/501
2012/0236021 A1* 9/2012 Parmar ..... G09G 3/2044 345/597

FOREIGN PATENT DOCUMENTS

| | | |
|---|---|---|
| CN | 101567089 A | 10/2009 |
| TW | 200820122 | 5/2008 |
| TW | 201234868 | 8/2012 |
| TW | 201243798 | 11/2012 |
| TW | 201246161 | 11/2012 |
| TW | 201324473 | 6/2013 |

* cited by examiner

*Primary Examiner* — Chad Dicke
(74) *Attorney, Agent, or Firm* — Winston Hsu; Scott Margo

(57) ABSTRACT

A self refresh method with dithering has at least the following steps: generating a plurality of original frames; performing a dithering process upon the plurality of original frames to generate a plurality of dithering frames to a timing controller; checking if the plurality of original frames is unaltered; and when it is detected that the plurality of original frames is unaltered, requesting the timing controller to enter a self refresh mode, and stopping transmission of dithering frames after transmitting a specific frame and dithering information associated with the specific frame to the timing controller for further dithering processing.

24 Claims, 8 Drawing Sheets

METHOD FOR PERFORMING DITHERING UPON BOTH NORMAL MODE AND SELF REFRESH MODE IN LOWER TRANSMISSION DATA RATE AND RELATED APPARATUS

BACKGROUND OF THE INVENTION

1. Field of the Invention

The disclosed embodiments of the present invention relate to a dithering technique, and more particularly, to a method for performing dithering upon both the normal mode and the self refresh mode in a lower transmission data rate and related apparatus thereof .

2. Description of the Prior Art

Generally, a panel related processor or controller may use a dithering circuit for reducing the bandwidth and the buffer size therein, while still preventing the distortion from being easily noticed by human eyes in normal situations. However, the prior art is still imperfect and encounters dilemmas in many situations. For instance, please refer to FIG. 1, which is a diagram illustrating a conventional display processing system 100. The design of the display processing system 100 keeps the image quality for both the normal mode and the self refresh mode by disposing a dithering module 128 in the last stage of the whole circuit. In other words, both the 10-bit normal frames and the 10-bit self refresh frames coming from the preceding circuits are inputted into the dithering module 128, and then are outputted as an 8-bit dithering frame. One drawback of this kind of conservative design is the data path keeps being 10-bit for each channel till the end of the whole circuit (before the dithering module 128), and the frame buffer 124 is also for 10-bit frame size.

For another instance, please refer to FIG. 2, which is another diagram illustrating a conventional display processing system 200. The design of the display processing system 200 solves the problems encountered in the above mentioned architecture by disposing a dithering module 214 before the timing controller (TCON) 220. However, the processing system 200 keeps the image quality only for the normal mode. In other words, the last frame of the dithering frames is directly outputted to the display including the distortion induced by the 10-bit to 8-bit process in the dithering module 214.

SUMMARY OF THE INVENTION

Thus, one of the objectives of the present invention is to provide a method for performing dithering, and more particularly, to provide a method for performing dithering upon both the normal mode and the self refresh mode in a lower transmission data rate and related apparatus thereof, to solve the problem mentioned above.

According to a first embodiment of the present invention, a self refresh method with dithering is disclosed. The self refresh method with dithering includes: generating a plurality of original frames; performing a dithering process upon the plurality of original frames to generate a plurality of dithering frames to a timing controller; checking if the plurality of original frames is unaltered; and when it is detected that the plurality of original frames is unaltered, requesting the timing controller to enter a self refresh mode, and stopping transmission of dithering frames after transmitting a specific frame and a dithering information associated with the specific frame to the timing controller for further dithering processes.

According to a second embodiment of the present invention, a self refresh method with dithering is disclosed. The self refresh method with dithering includes: checking if a request for a self refresh mode is received; and when detected that the request for the self refresh mode is received, receiving a specific frame and a dithering information associated with the specific frame from a display processor, and performing a local dithering process according to the specific frame and the dithering information to generate a plurality of self refreshed frames.

According to a third embodiment of the present invention, a self refresh apparatus with dithering is disclosed. The self refresh apparatus with dithering includes a frame generator, a dithering module, a control module, and a transmitter. The frame generator is arranged for generating a plurality of original frames. The dithering module is coupled to the frame generator and arranged for receiving the plurality of original frames from the frame generator and performing a dithering process upon the plurality of original frames to generate a plurality of dithering frames. The control module is coupled to the frame generator and the dithering module, arranged for checking if the plurality of original frames is unaltered, and requesting the timing controller to enter a self refresh mode when the control module detects that the plurality of original frames is unaltered. The transmitter is coupled to the control module and the dithering module, arranged for transmitting the plurality of dithering frames to a timing controller, and when the control module detects that the plurality of original frames is unaltered, stopping transmitting dithering frames after transmitting a specific frame and a dithering information associated with the specific frame to the timing controller for further dithering processing.

According to a fourth embodiment of the present invention, a self refresh apparatus with dithering is disclosed. The self refresh apparatus with dithering includes a receiver and an auxiliary dithering module. The receiver is arranged for checking if a request for a self refresh mode is received, when it is detected that the request for the self refresh mode is received, receiving a specific frame and dithering information associated with the specific frame. The auxiliary dithering module is coupled to the receiver and arranged for performing a local dithering process according to the specific frame and the dithering information to generate a plurality of self refreshed frames.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
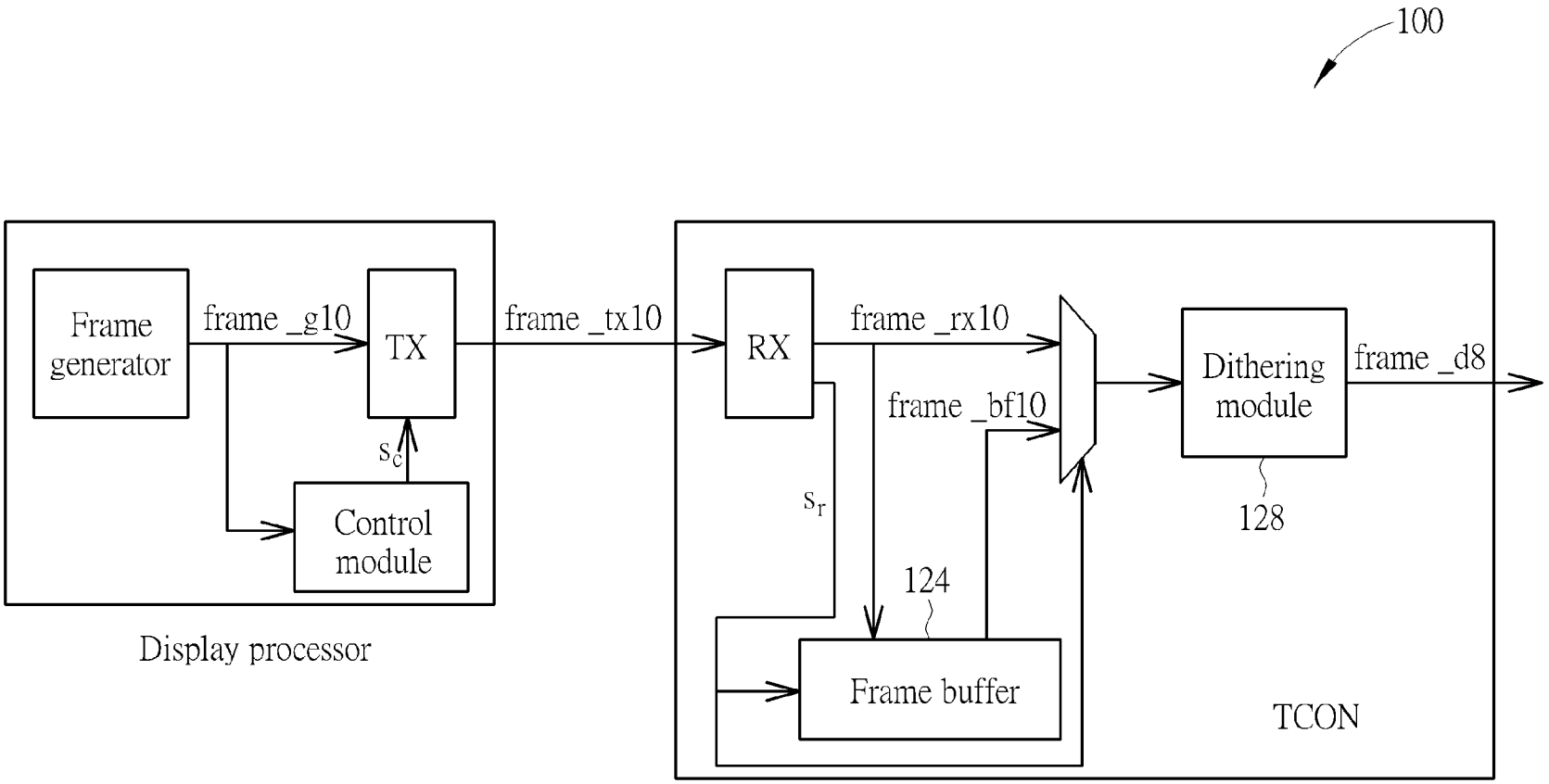
FIG. 1 PRIOR ART
FIG. 1 is a diagram illustrating a conventional display processing system.
Figure 2:
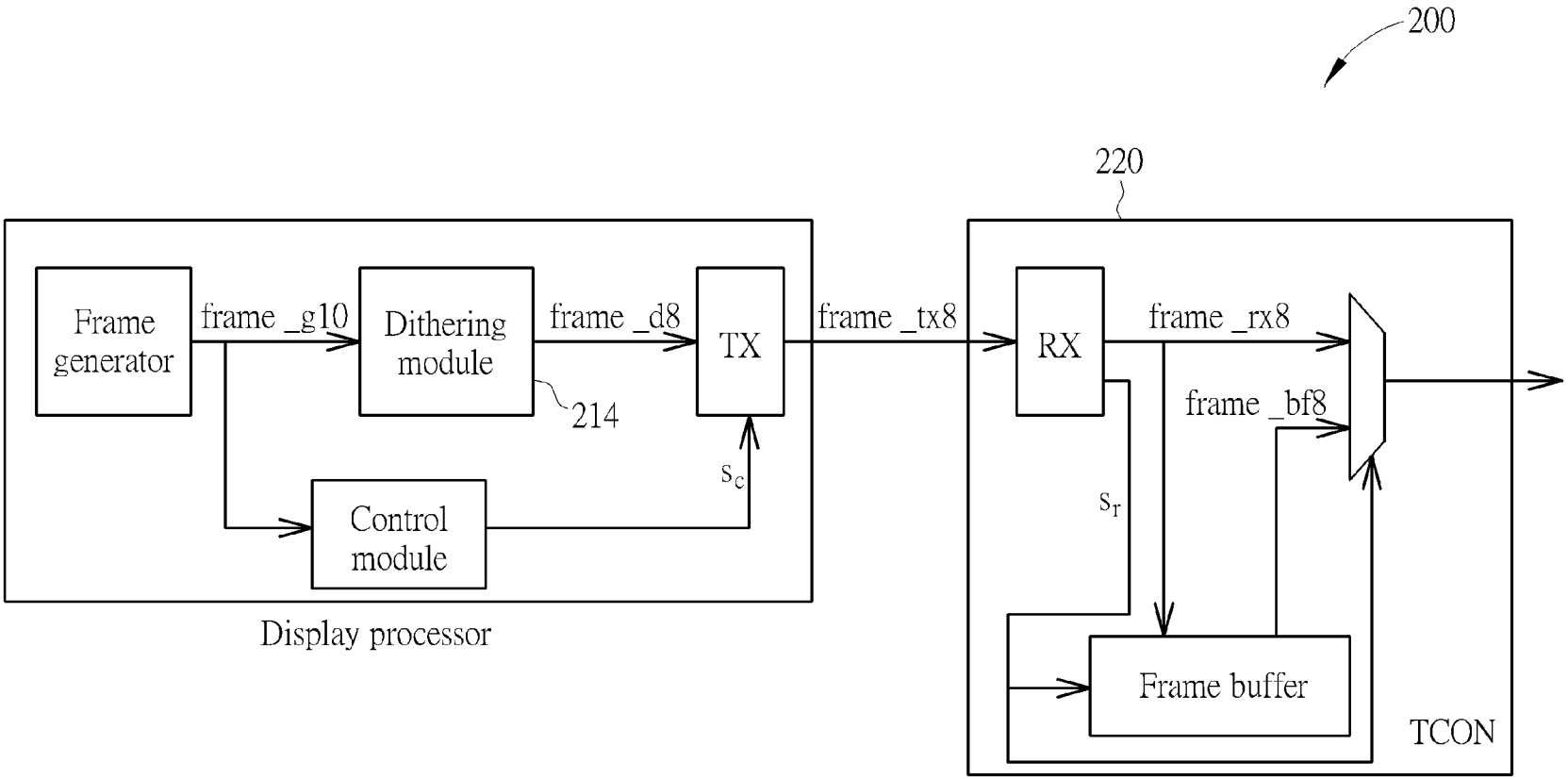
FIG. 2 PRIOR ART
FIG. 2 is a diagram illustrating another conventional display processing system.
Figure 3:
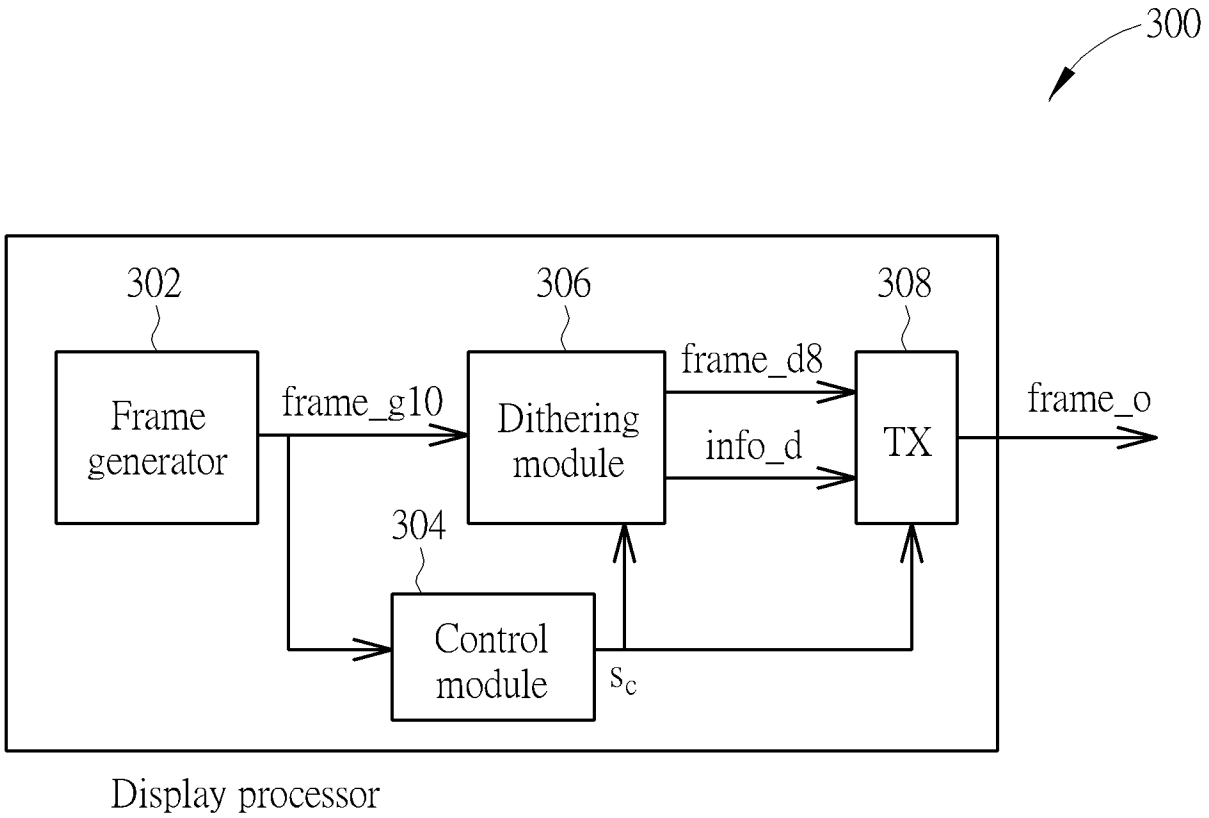
FIG. 3 is a diagram illustrating a display processor according to an embodiment of the present invention.

Please refer to FIG. 3, which is a diagram illustrating a display processor 300 according to an embodiment of the present invention. The display processor 300 includes a frame generator 302, a control module 304, a dithering module 306, and a transmitter (TX) 308. The frame generator 302 generates a plurality of original frames frame_g10, each being a 10-bit data and inputted into the control module 304 and the dithering module 306 respectively. Please note that the bit width of the data path is for illustrative purposes only. In practice, the present invention can be applied to alternative designs with different specifications, such as 12-bit original frames. The dithering module 306 performs a dithering process upon the original frames frame_g10 to generate a plurality of dithering frames frame_d8 to the TX 308 in the normal mode. The control module 304 checks if the original frames frame_g10 are unaltered for a period of time (e.g., 1 second or 20 consecutive frames). When it is detected that the original frames frame_g10 are unaltered, the control module 304 instructs the display processor 300 to enter the self refresh mode from the normal mode, and generate a signal $S_c$ to request the dithering module 306 to transmit a specific frame and dithering information info_d associated with the specific frame to the TX 308 such that the following circuit can reconstruct the dithering frames in the self refresh mode, which is detailed later.

Figure 4:
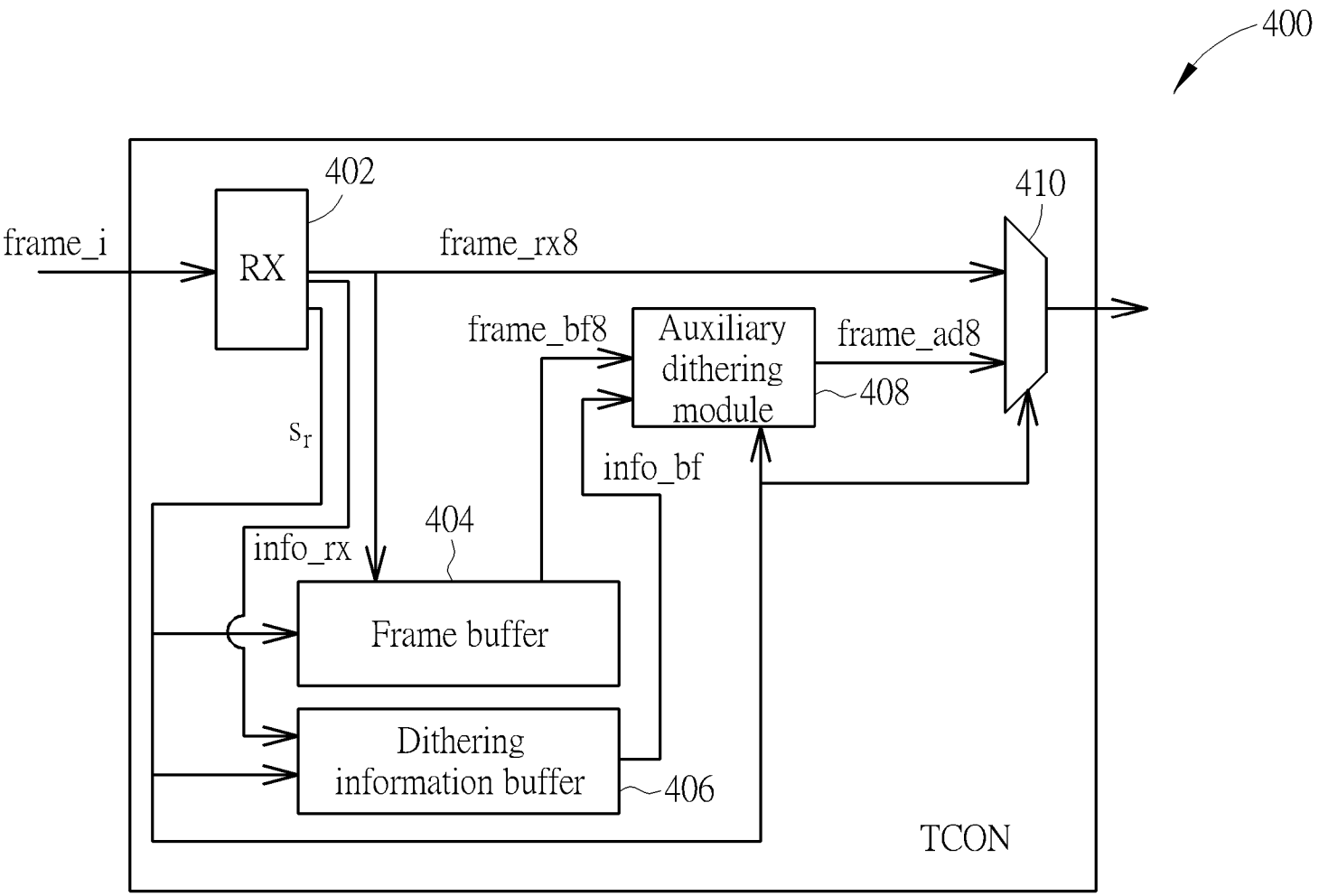
FIG. 4 is a diagram illustrating a timing controller 400 according to an embodiment of the present invention.

Please refer to FIG. 4, which is a diagram illustrating a timing controller (TCON) 400 according to an embodiment of the present invention. The TCON 400 includes a receiver, hereinafter RX, 402, a frame buffer 404, a dithering information buffer 406, an auxiliary dithering module 408, and a multiplexer (MUX) 410. The RX 402 receives the 8-bit incoming frames frame_rx8 in the normal mode and pass it to the subsequent stage such as a display or panel via the MUX 410; meanwhile, the RX 402 checks if a request for a self refresh mode is received. When it is detected that the request for the self refresh mode is received, the RX 402 generates a signal $S_r$ to request the TCON 400 to enter the self refresh mode. After that, the RX 402 receives the specific frame and the dithering information info_rx associated with the specific frame transmitted from the display processor 300, and the RX 402 passes the specific frame and the dithering information info_rx to the frame buffer 404 and the dithering information buffer 406 respectively. Finally, the auxiliary dithering module 408 is able to perform a local dithering process according to a specific frame frame_bf8 from the frame buffer 404 and dithering information info_bf from the dithering information buffer 406 to generate a plurality of self refreshed frames frame_ad8 to the MUX 410.

The dithering module 306 sends the dithering information info_d which has enough information for the auxiliary dithering module 408 to recovery the received 8-bit specific frame frame_bf8 to the 10-bit original frame frame_g10 generated by the frame generator 302. The auxiliary dithering module 408 can perform a complete dithering process during the self refresh mode instead of transmitting identical frames repeatedly after leaving the normal mode. Or the dithering module 306 could just transmit a complete set of dithering frames to the TCON 400, and the auxiliary dithering module 408 can directly transmit the complete set of dithering frames repeatedly to the display. For instance, regarding the 10 bit/8 bit dithering module 306, a complete set of dithering frames includes four different frames. This is for illustrative purposes only. Any alternative design which allows the dithering information and the specific frame to be utilized by the TCON 400 to perform the local dithering process during the self refresh mode would still belong to the scope of the present invention.

Figure 5:
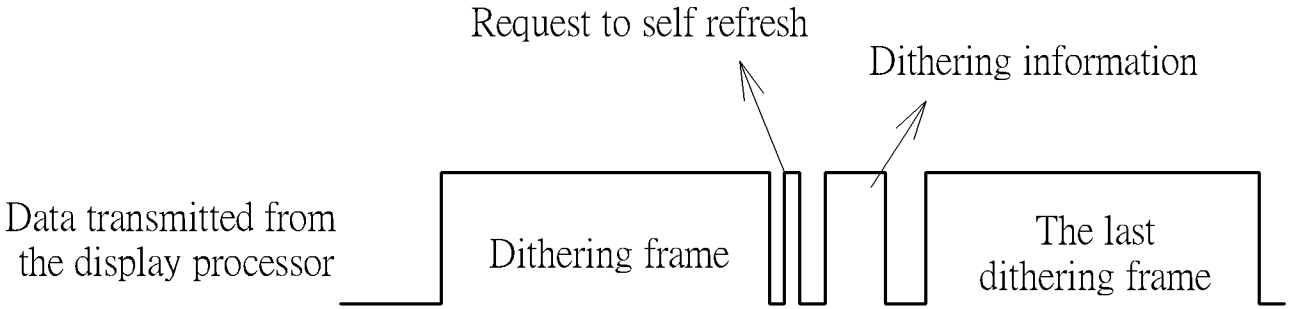
FIG. 5 is a diagram illustrating one of the methods for inserting the dithering information into the frames data stream.

One of the methods for inserting the dithering information info_d into the frame data stream is illustrated in FIG. 5, in which the system is about to request the self refresh mode. As shown in FIG. 5, a self refresh request command is transmitted, and then the last dithering frame is transmitted next in conventional designs. According to the above mentioned embodiment, the specific frame may be treated as the last dithering frame and sent out after the self refresh request command. Moreover, there is an empty time period (i.e., the vertical blanking interval) between successive frames, therefore we can put the dithering information between the self refresh request command and the specific frame (i.e., the last dithering frame). Therefore, when the RX 402 of the TCON 400 receives the self refresh request command, the TCON 400 enters the self refresh mode, and have the dithering information info_rx and the specific frame stored in the dithering information buffer 406 and the frame buffer 404 respectively.

Figure 6:
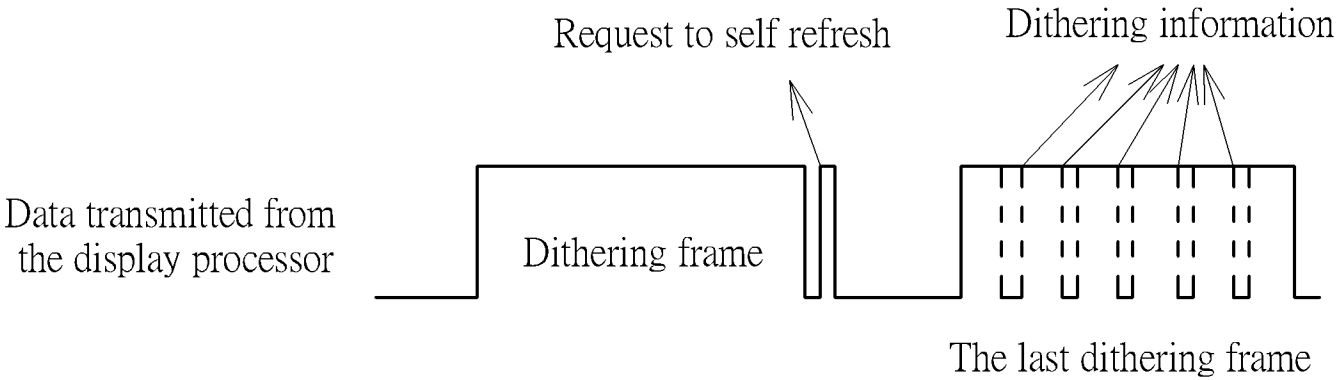
FIG. 6 is a diagram illustrating another one of the methods for inserting the dithering information into the frames data stream.

Another one of the methods for inserting the dithering information info_d into the frame data stream is illustrated in FIG. 6, in which the system is also about to request for the self refresh mode. As shown in FIG. 6, there are short empty time intervals (e.g., horizontal blanking intervals) within each frame, as illustrated by the dotted lines. Hence, we can break the dithering information into parts first, and utilize the space to put the parts into those short time intervals within the specific frame (i.e., the last dithering frame). Therefore, when the RX 402 of the TCON 400 receives the self refresh request command, the TCON 400 enters the self refresh mode, and have the dithering information info_rx and the specific frame stored in the dithering information buffer 406 and the frame buffer 404 respectively.

Figure 7:
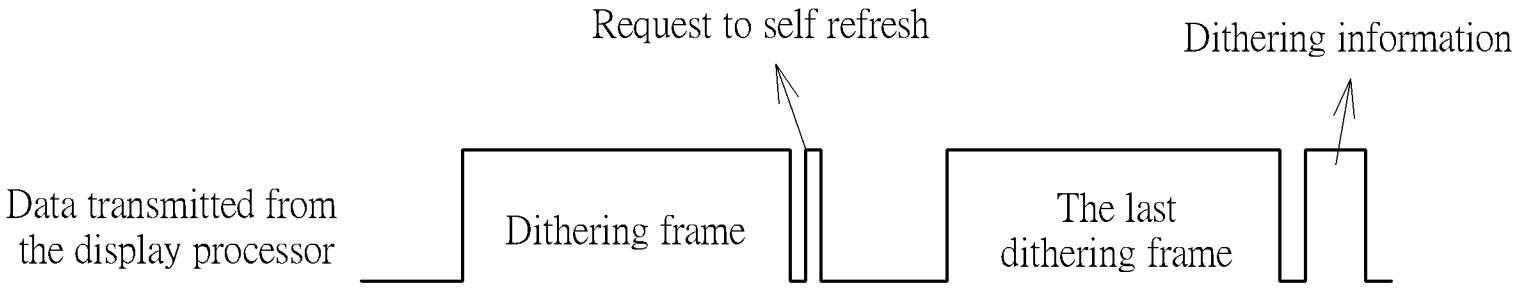
FIG. 7 is a diagram illustrating yet another one of the methods for inserting the dithering information into the frames data stream.

Yet another one of the methods to insert the dithering information info_d into the frames data stream is illustrated in FIG. 7, in which the system is about to request the self refresh mode. As shown in FIG. 7, after sending the last dithering frame, the display processor 300 stops transmitting any frame to the TCON 400 till the time the control module 304 of the display processor 300 determines to leave the self refresh mode, which means that there should be an empty time period after the specific frame (i.e., the last dithering frame) is sent. Hence, the space to put the dithering information can be utilized. Therefore, when the RX 402 of the TCON 400 receives the self refresh request command, the TCON 400 enters the self refresh mode, and has the dithering information info_rx and the specific frame be stored in the dithering information buffer 406 and the frame buffer 404 respectively.

Figure 8:
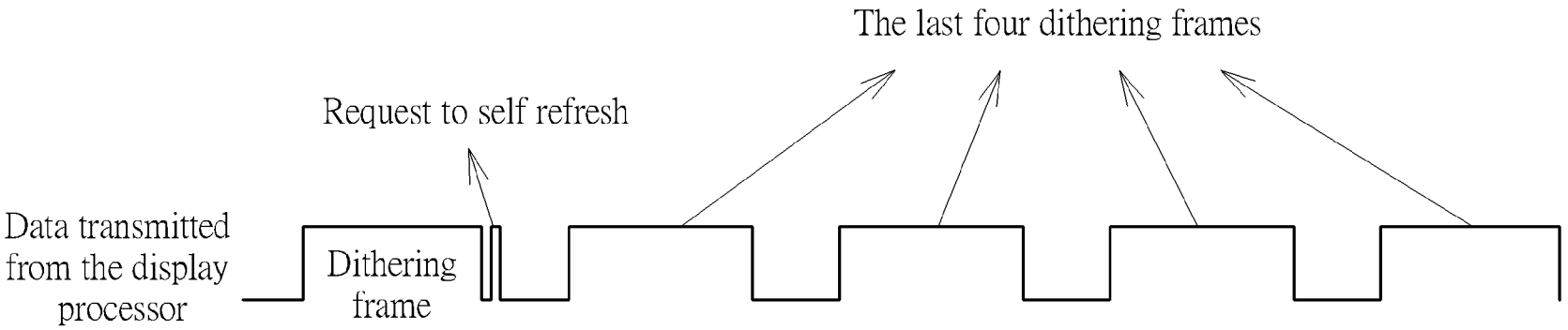
FIG. 8 is a diagram illustrating yet another one of the methods for inserting the dithering information into the frames data stream.

Yet another one of the methods for inserting the dithering information $info_{13}$ d into the data stream of the frames is illustrated in FIG. 8, in which the system is about to request for the self refresh mode. As shown in FIG. 8, after sending the last dithering frame, as mentioned above, the display processor 300 stops transmitting any frame to the TCON 400 till the time the control module 304 of the display processor 300 determines to leave the self refresh mode, which means that there should be an empty time period after the last dithering frame is sent. Hence, the space to put the rest of the complete set of dithering frames can be utilized (i.e., in accordance with the 10 bit/8 bit system of the embodiment of the present invention, four dithering frames are sent, wherein the first one can be regarded as the last dithering frame (the specific frame) and the second through the fourth ones can be regarded as the dithering information). Therefore, when the RX 402 of the TCON 400 receives the self refresh request command, the TCON 400 enters the self refresh mode, and have the specific frame (i.e., the first of the complete set of dithering frames) and the dithering information info_rx (i.e., the rest of the complete set of dithering frames) be stored in the frame buffer 404 and the dithering information buffer 406 respectively, and the auxiliary dithering module 408 repeatedly transmits the four frames to the subsequent stage via the switch 410.

Designs based on the above alternatives and other further extensions all fall within the scope of the present invention. In addition, the methods for inserting the dithering information into the data stream of the frames shown in the different embodiments can also be employed jointly. Many embodiments and drawings mentioned above have explained the principle, details and derivative changes of the self refresh method with dithering of the present invention. Therefore, further descriptions of the video generating method of the present invention are omitted here for brevity.

The term "one embodiment" mentioned above represents a particular feature, structure, or characteristic described for the embodiment and are included in at least one implementation of the present invention. Furthermore, the term "one embodiment" appearing in different paragraphs represents a different embodiment. Therefore, although different structural features or methods are described for the different embodiments described above, but it should be noted that these different characteristics may be implemented on the same specific embodiment through appropriate modifications.

In summary, the video quality can be maintained a have a lower bandwidth and buffer usage by sending slightly more information each time when switching to the self refresh mode and controlling the auxiliary dithering module appropriately.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A self refresh method with dithering, comprising:

generating a plurality of original frames;

performing a first dithering process upon the plurality of original frames to generate a plurality of dithering frames to a timing controller, the plurality of original frames each having a first bit width, the plurality of dithering frames each having a second bit width narrower than the first bit width;

checking if the plurality of original frames is unaltered; and when it is detected that the plurality of original frames is unaltered, requesting the timing controller to enter a self refresh mode, and stopping transmission of dithering frames after transmitting a specific dithering frame and dithering information associated with the specific dithering frame to the timing controller for further dithering processing so that the timing controller under the self refresh mode performs a second dithering process to generate a plurality of self refreshed frames by referring to the specific dithering frame and the dithering information to generate the self refreshed frames; the dithering information and the specific dithering frame having the second bit width are used to generate a plurality of frames, which have the first bit width and then are processed by the second dithering process of the timing controller to generate the self refreshed frames at the second bit width narrower than the first bit width of each original frame when the plurality of original frames are unaltered.

2. The self refresh method with dithering of claim 1, wherein the step of transmitting the specific dithering frame and the dithering information associated with the specific dithering frame comprises:

transmitting the dithering information in a vertical blanking interval preceding the specific dithering frame.

3. The self refresh method with dithering of claim 1, wherein the step of transmitting the specific dithering frame and the dithering information associated with the specific dithering frame comprises:

transmitting the dithering information in at least one horizontal blanking interval within the specific dithering frame.

4. The self refresh method with dithering of claim 1, wherein the step of transmitting the specific dithering frame and the dithering information associated with the specific dithering frame comprises:

transmitting the dithering information after the specific dithering frame is transmitted.

5. The self refresh method with dithering of claim 4, wherein the specific dithering frame and the dithering information include successive dithering frames of the plurality of dithering frames.

6. The self refresh method with dithering of claim 1, wherein the specific dithering frame is one of the plurality of dithering frames.

7. A self refresh method with dithering, comprising:

checking if a request for a self refresh mode is received; and when it is detected that the request for the self refresh mode is received, receiving a specific dithering frame of a first dithering process and dithering information associated with the specific dithering frame from a display processor, and performing a second dithering process of a timing controller under the self refresh mode by referring to the specific dithering frame and the dithering information to generate a plurality of self refreshed frames, each of original frames generated by the display processor having the first bit width, the specific dithering frame having a second bit width narrower than the first bit width, the dithering information and the specific dithering frame having the second bit width are used to generate a plurality of frames, which have the first bit width and then are processed by the second dithering process of the timing controller to generate the self refreshed frames at the second bit width narrower than the first bit width of each original frame when the plurality of original frames are unaltered.

8. The self refresh method with dithering of claim 7, wherein the step of receiving the specific dithering frame and the dithering information associated with the specific dithering frame comprises:

receiving the dithering information in a vertical blanking interval preceding the specific dithering frame.

9. The self refresh method with dithering of claim 7, wherein the step of receiving the specific dithering frame and the dithering information associated with the specific dithering frame comprises:

receiving the dithering information in at least one horizontal blanking interval within the specific dithering frame.

10. The self refresh method with dithering of claim 7, wherein the step of receiving the specific dithering frame and the dithering information associated with the specific dithering frame comprises:

receiving the dithering information after the specific dithering frame is received.

11. The self refresh method with dithering of claim 10, wherein the specific dithering frame and the dithering information include successive dithering frames.

12. The self refresh method with dithering of claim 7, wherein the specific dithering frame is a dithering frame generated from the display processor.

13. A self refresh apparatus with dithering, comprising:

a frame generator, arranged for generating a plurality of original frames;

a dithering module, coupled to the frame generator, arranged for receiving the plurality of original frames from the frame generator and performing a first dithering process upon the plurality of original frames to generate a plurality of dithering frames, the plurality of original frames each having a first bit width, the plurality of dithering frames each having a second bit width narrower than the first bit width;

a control module, coupled to the frame generator and the dithering module, arranged for checking if the plurality of original frames is unaltered, and requesting a timing controller to enter a self refresh mode when the control module detects that the plurality of original frames is unaltered; and a transmitter, coupled to the control module and the dithering module, arranged for transmitting the plurality of dithering frames to the timing controller, and when the control module detects that the plurality of original frames is unaltered, stopping transmitting dithering frames after transmitting a specific dithering frame and dithering information associated with the specific dithering frame to the timing controller for further dithering processing so that the timing controller under the self refresh mode performs a second dithering process to generate a plurality of self refreshed frames by referring to the specific dithering frame and the dithering information to generate the self refreshed frames, the dithering information and the specific dithering frame having the second bit width are used to generate a plurality of frames, which have the first bit width and then are processed by the second dithering process of the timing controller to generate the self refreshed frames at the second bit width narrower than the first bit width of each original frame when the plurality of original frames are unaltered.

14. The self refresh apparatus with dithering of claim 13, wherein the transmitter transmits the dithering information in a vertical blanking interval preceding the specific dithering frame.

15. The self refresh apparatus with dithering of claim 13, wherein the transmitter transmits the dithering information in at least one horizontal blanking interval within the specific dithering frame.

16. The self refresh apparatus with dithering of claim 13, wherein the transmitter transmits the dithering information after the specific dithering frame is transmitted.

17. The self refresh apparatus with dithering of claim 16, wherein the specific dithering frame and the dithering information include successive dithering frames of the plurality of dithering frames.

18. The self refresh apparatus with dithering of claim 13, wherein the specific dithering frame is one of the plurality of dithering frames.

19. A self refresh apparatus with dithering, comprising:

a receiver, arranged for checking if a request for a self refresh mode is received, when it is detected that the request for the self refresh mode is received, receiving a specific dithering frame of a first dithering process and dithering information associated with the specific dithering frame from a display processor; and an auxiliary dithering module, coupled to the receiver, arranged for performing a second dithering process of a timing controller under the self refresh mode by referring to the specific dithering frame and the dithering information to generate a plurality of self refreshed frames, each of original frames generated by the display processor having the first bit width, the specific dithering frame having a second bit width narrower than the first bit width, the dithering information and the specific dithering frame having the second bit width are used to generate a plurality of frames, which have the first bit width and then are processed by the second dithering process of the timing controller to generate the self refreshed frames at the second bit width narrower than the first bit width of each original frame when the plurality of original frames are unaltered.

20. The self refresh apparatus with dithering of claim 19, wherein the receiver receives the dithering information in a vertical blanking interval preceding the specific dithering frame.

21. The self refresh apparatus with dithering of claim 19, wherein the receiver receives the dithering information in at least one horizontal blanking interval within the specific dithering frame.

22. The self refresh apparatus with dithering of claim 19, wherein the receiver receives the dithering information after the specific dithering frame is received.

23. The self refresh apparatus with dithering of claim 22, wherein the specific dithering frame and the dithering information include successive dithering frames.

24. The self refresh apparatus with dithering of claim 19, wherein the specific dithering frame is a dithering frame generated from the display processor.

* * * * *